United States Patent [19]

Sarebjörk et al.

[11] 4,324,735

[45] Apr. 13, 1982

[54] METHOD FOR WINTERIZING (DEWAXING) OF VEGETABLE OILS

[75] Inventors: Karl W. H. Sarebjörk, Tumba; Anders B. Pallmar, Tullinge, both of Sweden

[73] Assignee: Alfa-Laval AB, Tumba, Sweden

[21] Appl. No.: 164,535

[22] Filed: Jul. 2, 1980

[30] Foreign Application Priority Data

Jul. 9, 1979 [SE] Sweden ..... 7905963

[51] Int. Cl.[3] ..... C11B 3/06

[52] U.S. Cl. ..... 260/425

[58] Field of Search ..... 260/425, 426

[56] References Cited

U.S. PATENT DOCUMENTS 4,035,402 7/1977 Levine ..... 260/425

*Primary Examiner*—John F. Niebling

*Attorney, Agent, or Firm*—Cyrus S. Hapgood

[57] ABSTRACT

A method for winterizing (dewaxing) of vegetable oils is described. The method is of an art, comprising the steps of neutralizing the oil, chilling it, mixing in an alkali solution, slow stirring during a residence time to make waxes and other high melting matters precipitate, and removal of same.

The present method is especially characterized by the fact that the neutralizing is driven to a soap content of 100–7000 ppm, and that the oil is chilled to a temperature below 15° C., preferably 5°–15° C., and that lye or other alkali is added, corresponding to 0.01–0.06 kgs NaOH per 100 kgs oil, the sequence chilling/addition being optional, whereupon 3–10 kgs water per 100 kgs oil are added with intense agitation, and the mixture so obtained is stirred slowly for more than 1 hour, preferably 1–7 hours, whereupon the mixture so obtained is separated into a heavy fraction, containing water- lye- soap- waxes- and other high melting matters and a lighter fraction consisting of the winterized oil.

7 Claims, 1 Drawing Figure

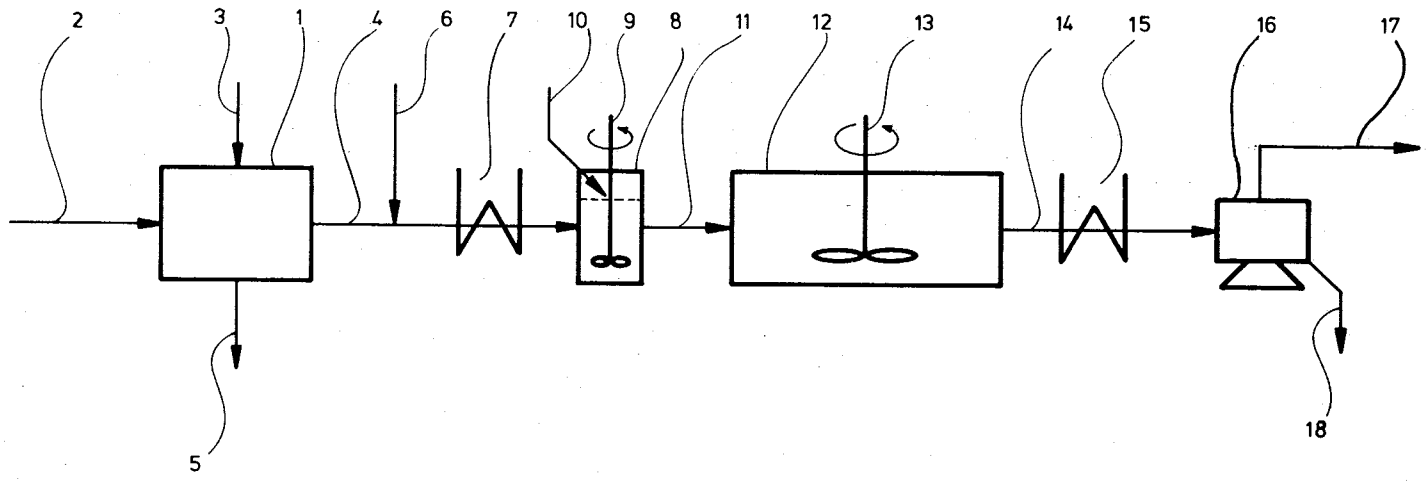
2
3
1
4
6
7
10
9
8
11
12
13
14
15
16
17
18
5

METHOD FOR WINTERIZING (DEWAXING) OF VEGETABLE OILS

BACKGROUND OF THE INVENTION

This invention relates to a method for winterizing (dewaxing) of vegetable oils, comprising neutralizing the oil, chilling, mixing with an alkaline solution, gentle stirring during a resident time in order that waxes and other high melting matters are precipitated, and removal of same.

Some oils, like sunflower oil contain small quantities of high melting matter, e.g. waxes and tristearines, which precipitate during storage in refrigerators and also after prolonged storage at ambient temperature. In the vegetable oil industry different methods have been applied since a long time in order to remove such high melting matters from the oils in question, especially sunflower oil.

Thus one method has been applied, in which the refined oil is chilled to a temperature, at which said matters crystallize after some time and can be removed by filtration. Due to the crystal structure and the high viscosity of the oil at the filtering temperature this is a difficult and tedious procedure, which is also expensive. Thus more efficient methods has been sought for removal of waxes and other high melting matters from vegetable oils. One method of the art mentioned introductorily is disclosed in U.S. Pat. No. 4,035,402.

This process for dewaxing of vegetable oils comprises the steps of (a) prerefining of vegetable oil till it contains less than 1000 ppm soap and less than 1000 FFA and chilling to a temperature below 15° C.;

(b) holding said oil at said temperature for more than one hour;

(c) mixing of the oil from step (b) with an alkaline water solution;

(d) agitation of the mixture from (c) in a low shear-high circulation manner for at least ½ hour to uniformly disperse the alkaline solution without forming an inseparable emulsion;

(e) separating the agitated mixture to provide a wax containing water phase and an oil phase.

It is stated that 10 to about 30% (weight) alkaline solution, calculated on the mixture so obtained, shall be added. This means that 11–43 kgs alkaline solution are added to 100 kgs oil. It is stated as quite important that if for instance NaOH is used as alkali, the concentration of same shall be within an interval of 1.0–2.5% (weight) in the alkaline solution, as the process is said not to be satisfactorily operable at lower or higher concentrations.

In fact it has become obvious that it is difficult to get a process of this type to operate well. Thus there is a need for a process of the art mentioned introductorily, which operates well, in which there are only minor losses of neutral oil and which is economical in operation.

SUMMARY OF THE INVENTION

According to the invention such a process comprises the following steps:

The oil is neutralized to a soap content of 100–7000 ppm, and is then chilled to a temperature below 15° C., preferably 5°–15° C. and lye or other alkali corresponding to 0.01–0.06 kgs NaOH per 100 kgs oil is added, the sequence chilling/addition being optional, whereupon 3–10 kgs water is added per 100 kgs oil with intense agitation. Then the mixture so obtained is held with slow stirring for more than 1 hour, preferably 1–7 hours, whereupon the mixture is separated into one heavy fraction containing water- lye- wax- and other high melting matters, and one lighter fraction, consisting of the winterized (dewaxed) oil, the mixture preferably being heated to 15°–20° C. before the separation.

After these process steps the oil is washed warm, is bleached and is deodorized.

It is especially suitable if the neutralized oil contains about 2000 ppm soap.

A suitable addition to the oil of lye or other alkali corresponds to 0.025 kg NaOH per 100 kgs oil.

In order to facilitate the separation into a heavy and a lighter fraction it may be suitable to add phosphoric acid, citric acid or the like to the mixture before the separation in order to facilitate and improve same.

The method according to the invention has many advantages. It is efficient, economical in operation and shows a low neutral oil loss. There is no risk for the formation of an emulsion, contrary to the situation in the process which is disclosed in the U.S. Pat. No. 4,035,402.

DETAILED DESCRIPTION OF THE INVENTION

The method shall now be described more in detail, reference being made to the accompanying FIGURE.

In the FIGURE, there is shown schematically a plant for carrying out the method according to the invention. A neutralizing plant 1 is provided with a feed line 2 for oil and a feed line 3 for lye, and a discharge line 4 for neutralized oil and a discharge line 5 for soap stock. Per se the neutralizing plant can consist of several stages and can also comprise special treatment steps, as with phosphoric acid etc. Line 4 is provided with a feed line 6 for lye or other alkaline solution, and is connected to a heat exchanger 7 for chilling of incoming oil with addition of lye, and is further connected to a mixing tank 8, provided with a fastrunning mixer 9 for intense agitation and a feed line 10 for water. A line 11 connects the tank 8 with a residence tank 12, in which a slow mixer 13 is arranged. The residence tank 12 is connected by a line 14 to a heat exchanger 15 for heating of the incoming mixture and further to a centrifugal separator 16, which is provided with a discharge 17 for oil, from which waxes and other high melting matters have been removed, and a discharge 18 for water- lye- soap-waxes- other high melting matters.

The plant operates in the following way:

A vegetable oil is firstly neutralized in neutralizing plant 1, whereupon the desired alkali quantity in solution is fed through feed line 6, and the mixture is conveyed to heat exchanger 7, in which it is chilled from a temperature of about 85° C.–90° C. to a temperature within the interval 5°–15° C. The mixture so chilled is fed to mixing tank 8, in which 3–10% (weight) water is mixed in with intense agitation with mixer 9. The mixture so obtained is conveyed to residence tank 12, in which it is held with slow stirring during an average residence time of 1 to 7 hours, whereupon it is heated to 15°–20° C. in heat exchanger 15 and is then separated in centrifugal separator 16, partly in oil, which leaves through discharge 17, and partly in water- lye- soap-waxes- other high melting matters, which leave through discharge 18.

As an illustration of applying the method according to the invention two examples may be mentioned.

EXAMPLE 1

Sunflower oil was refined and was winterized continuously with a capacity of 80 tons per 24 hours.

The analysis of the sunflower oil was as follows:
FFA 2.98%
Phosphatides 0.23%
Waxes 120 ppm After pretreatment with phosphoric acid and neutralizng an oil was obtained, containing 2000 ppm soap. To this oil was added at 90° C. 0.92 liters of 24° C. Be NaOH, whereupon the oil was chilled to 10° C. 6% (weight) water was mixed in with intense agitation, and the mixture was then stirred slowly during an average of 7 hours. After separation, warm wash, bleaching and deodorizing the oil remained clear after testing 24 hours at 0° C.+120 hours at 15° C., and has remained clear after several weeks of storage.

EXAMPLE 2

Sunflower oil was refined and winterized continuously with a capacity of 100 tons per 24 hours.

The analysis of the sunflower oil was as follows:
FFA 0.5%
Phosphatides 0.3%
Waxes 300 ppm After pretreatment with phosphoric acid and neutralizing an oil was obtained, containing 4000 ppm soap. To this oil was added at 90° C. 4.3 liters of 12 Be NaOH, whereupon the oil was chilled to 10° C. 6% (weight) water was mixed in with intense agitation, and the mixture was then stirred slowly during an average of 5 hours. After separation, warm wash, bleaching and deodorizing the oil remained clear after testing 24 hours at 0° C.+120 hours at 15° C. 3000 tons of sunflower oil were treated with as good result.

We claim:

1. A method for winterizing (dewaxing) vegetable oils characterized by the combination of the following steps:

(a) neutralizng the oil to a soap content of 100–7000 ppm;

(b) chilling of said oil to a temperature below 15° C., preferably 5–15° C. and addition to said oil of an alkali corresponding to 0.01– 0.06 kgs NaOH per 100 kgs oil;

(c) addition to said oil of 3–10 kgs water per 100 kgs oil with intense agitation;

(d) separation of the mixture so obtained into one heavy fraction containing water- lye- soap- waxes- other high melting matters and a lighter fraction consisting of the winterized (dewaxed) oil.

2. A method according to claim 2, characterized in that the oil is neutralized to a soap content of about 2000 ppm.

3. A method according to claim 1 or 2, characterized in that there is added to the oil an alkali corresponding to 0.025 kgs NaOH per 100 kgs oil.

4. A method according to claim 1, characterized in that there is added to the mixture phosphoric acid, citric acid or the like before separation into a heavy and a lighter fraction in order to facilitate this separation.

5. A method according to claim 1, characterized in that there is added to the mixture water before separation into a heavy and a lighter fraction in order to facilitate and improve this separation.

6. The method of claim 1, in which said alkali is lye.

7. The method of claim 1, comprising also the step of heating said mixture to 15°–20° C. before said separation.

* * * * *